US005966994A

United States Patent [19]

Woo

[11] Patent Number: 5,966,994

[45] Date of Patent: Oct. 19, 1999

[54] CABLE HOLDING DEVICE FOR ACCELERATOR PEDALS

[75] Inventor: Nam-Gyu Woo, Suwon, Rep. of Korea

[73] Assignee: Hyundai Motor Company, Seoul, Rep. of Korea

[21] Appl. No.: 09/030,589

[22] Filed: Feb. 25, 1998

[51] Int. Cl.[6] ..... G05G 5/22

[52] U.S. Cl. ..... 74/513; 74/500.5; 74/531; 74/538; 188/65.1

[58] Field of Search ..... 74/500.5, 513, 74/531, 538, 577 R, 577 S, 578; 188/65.1, 67

[56] References Cited

U.S. PATENT DOCUMENTS

| | | | |
|---|---|---|---|
| 2,557,365 | 6/1951 | Weber | 74/538 |
| 2,591,495 | 4/1952 | Baldwin, Jr. et al. | 74/538 |
| 2,604,115 | 7/1952 | Munson | 74/513 |
| 2,908,183 | 10/1959 | Giovanni | 74/513 |
| 2,936,651 | 5/1960 | McCleary | 74/513 |
| 3,000,475 | 9/1961 | Arpin | 74/513 |
| 3,143,192 | 8/1964 | Buchanan | 188/65.1 |
| 3,327,818 | 6/1967 | Gardner | 74/513 |
| 3,533,304 | 10/1970 | Shontz | 74/538 |
| 3,869,937 | 3/1975 | Ahrens | 74/513 |
| 4,057,130 | 11/1977 | Robertson | 74/513 |
| 4,621,525 | 11/1986 | King et al. | 73/117 |
| 4,791,855 | 12/1988 | Matsui | 188/67 |

*Primary Examiner*—Tamara L. Graysay
*Assistant Examiner*—Chong H. Kim
*Attorney, Agent, or Firm*—Christie, Parker & Hale LLP

[57] ABSTRACT

A cable holding device for accelerator pedals, allowing a driver to easily and conveniently drive a vehicle at a constant speed without continuously putting his foot down on an accelerator pedal, is disclosed. In the device, an accelerator cable connects an accelerator pedal to an engine's injection pump. A rod is provided at an end of the cable for connecting the injection pump and has a plurality of grooves on the outer surface. A cable holding unit selectively holds the rod so as to hold the cable at a previous state, thus allowing the vehicle to run at a constant speed when a pressure force is removed from the pedal. The device also has an actuating unit, which selectively actuates the cable holding unit so as to hold the cable by the cable holding unit.

2 Claims, 5 Drawing Sheets

CABLE HOLDING DEVICE FOR ACCELERATOR PEDALS

BACKGROUND OF THE INVENTION

1. Field of the Invention

The present invention relates, in general, to accelerator pedals of vehicles and, more particularly, to a cable holding device used with such an accelerator pedal so as to keep an accelerator cable connected to an injection pump without allowing the cable to be returned from the pump when a driver removes a pressure force from the pedal after the driver puts his foot down on the pedal, thus maintaining a previously depressed state of the pedal and allowing the driver to operate the vehicle at a constant speed without continuously putting his foot down on the pedal.

2. Description of the Prior Art

As well known to those skilled in the art, an accelerator pedal, which is used for controlling the running speed of a vehicle, is typically installed in the lower corner under the dashboard in front of a driver's seat in a cabin. Such an accelerator pedal is connected to an injection pump of an internal combustion engine through an accelerator cable and is designed to selectively pull the cable and increase the amount of fuel injected from the pump into the engine when a driver's foot is put down on the pedal. It is thus possible to selectively increase or reduce the running speed of a vehicle by controlling the pressure force on the accelerator pedal.

However, such a typical accelerator pedal is problematic in that the pedal cannot maintain a constant speed of a vehicle when a pressure force is removed from the pedal and so the typical accelerator pedal has to be steadily depressed by a driver when it is necessary to maintain the running speed of a vehicle at a constant speed. Therefore, such typical accelerator pedals cause drivers to be fatigued in their feet and legs in the event of a long-distance drive, thus being inconvenient to the users.

SUMMARY OF THE INVENTION

Accordingly, the present invention has been made keeping in mind the above problems occurring in the prior art, and an object of the present invention is to provide a cable holding device for accelerator pedals, which keeps an accelerator cable connected to an injection pump without allowing the cable to be returned from the pump when a driver removes a pressure force from the pedal after the driver puts his foot down on the pedal, thus maintaining a previously depressed state of the pedal and allowing the driver to drive the vehicle at a constant speed without continuously putting his foot down on the pedal.

In order to accomplish the above object, the present invention provides a cable holding device for accelerator pedals, comprising: an accelerator cable connecting an accelerator pedal to an injection pump of an engine; a rod at an end of said cable for connecting said injection pump, the rod having a plurality of grooves on the outer surface; a cable holding unit selectively holding the rod so as to hold the cable at a previous state, thus allowing a vehicle to run at a constant speed when a pressure force is removed from the pedal; and an actuating unit selectively actuating the cable holding unit so as to hold the cable by the cable holding unit.

BRIEF DESCRIPTION OF THE DRAWINGS

The above and other objects, features and other advantages of the present invention will be more clearly understood from the following detailed description taken in conjunction with the accompanying drawings, in which:

FIGS. 5A and 5B are sectional views showing the operation of the cable holding device of this invention, in which:

FIG. 5A shows a free state in which the cable is released from the cable holding device; and FIG. 5B shows a holding state in which the cable is held by the cable holding device.

DESCRIPTION OF THE PREFERRED EMBODIMENTS

Figure 1:
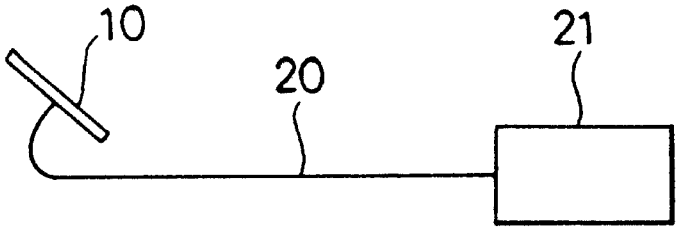
FIG. 1 (CONVENTIONAL ART)
FIG. 1 is a view showing a typical accelerator mechanism with an accelerator pedal being connected to an engine's injection pump through a cable.

As shown in FIGS. 1 to 6, the cable holding device of this invention comprises a cable 20, which connects an accelerator pedal 10 to an injection pump 21 of an internal combustion engine. The cable 20 has a rod 23 at an injection pump connection end thereof. The rod 23 has a plurality of projection parts 22 at the outer surface. The device also has a cable holding unit 30 and an actuating unit 40. The holding unit 30 selectively holds the rod 23, while the actuating unit 40 selectively operates the holding unit 30 so as to allow the holding unit 30 to hold the cable 20.

Figure 2:
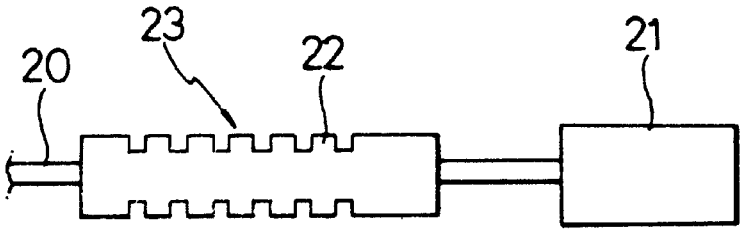
FIG. 2 is an enlarged view showing the configuration of the specifically-designed rod provided at the pump connection end of a cable in accordance with the present invention.
Figure 3:
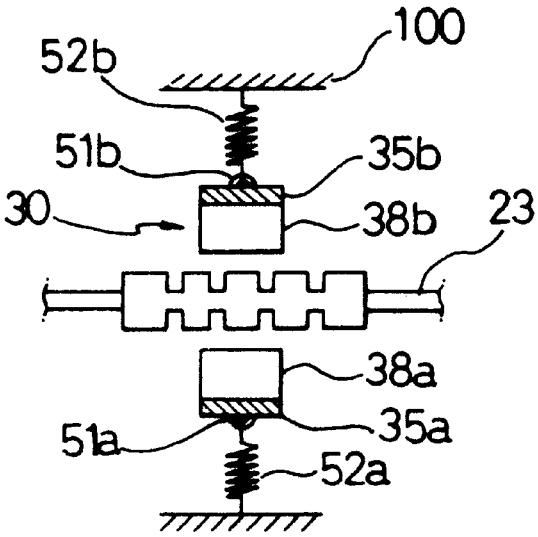
FIG. 3 is a sectional view showing the construction of the cable holding device according to the invention.
Figure 4:
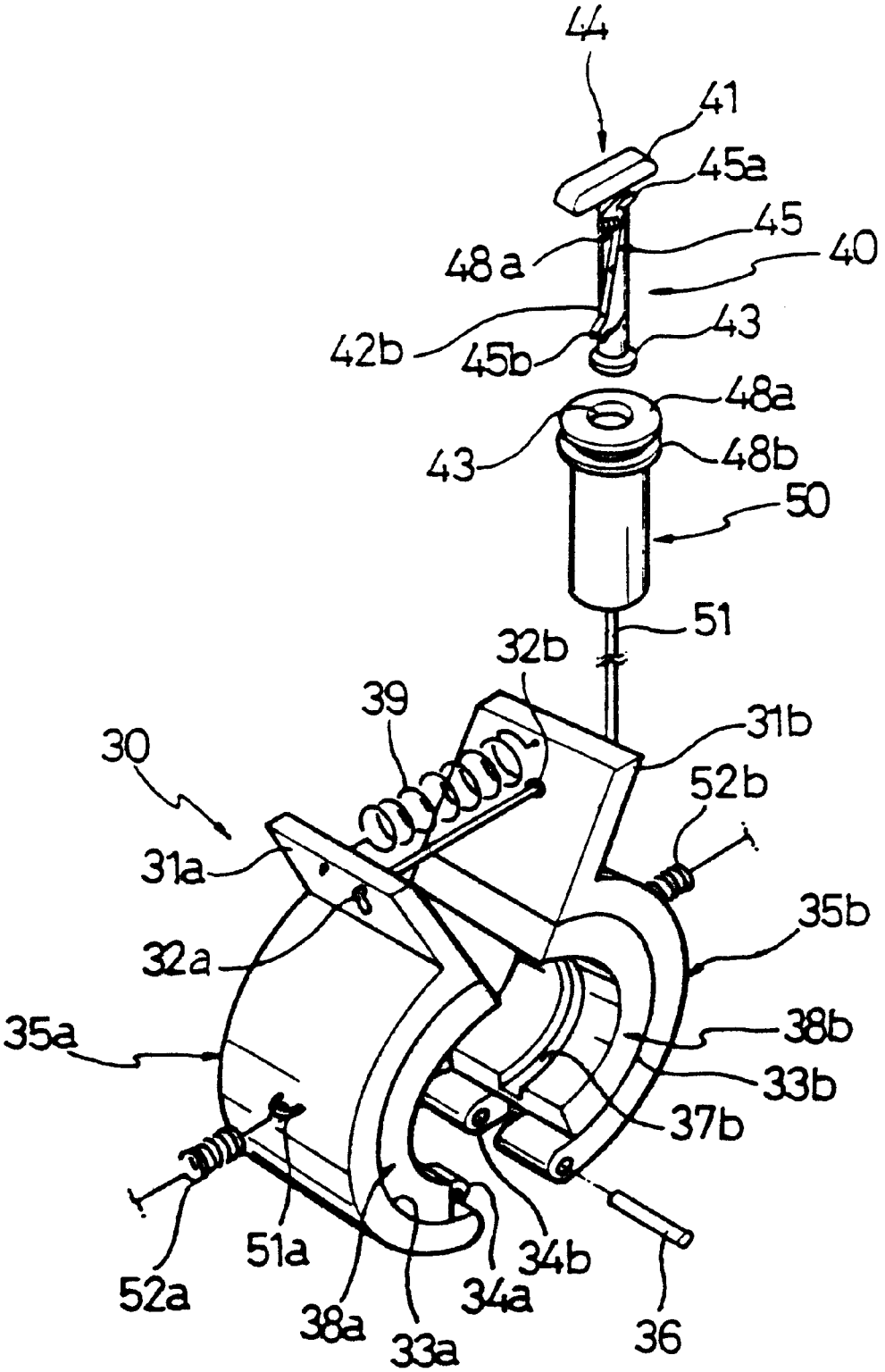
FIG. 4 is a perspective view showing the construction of the cable holding device according to the invention.
Figure 5A:
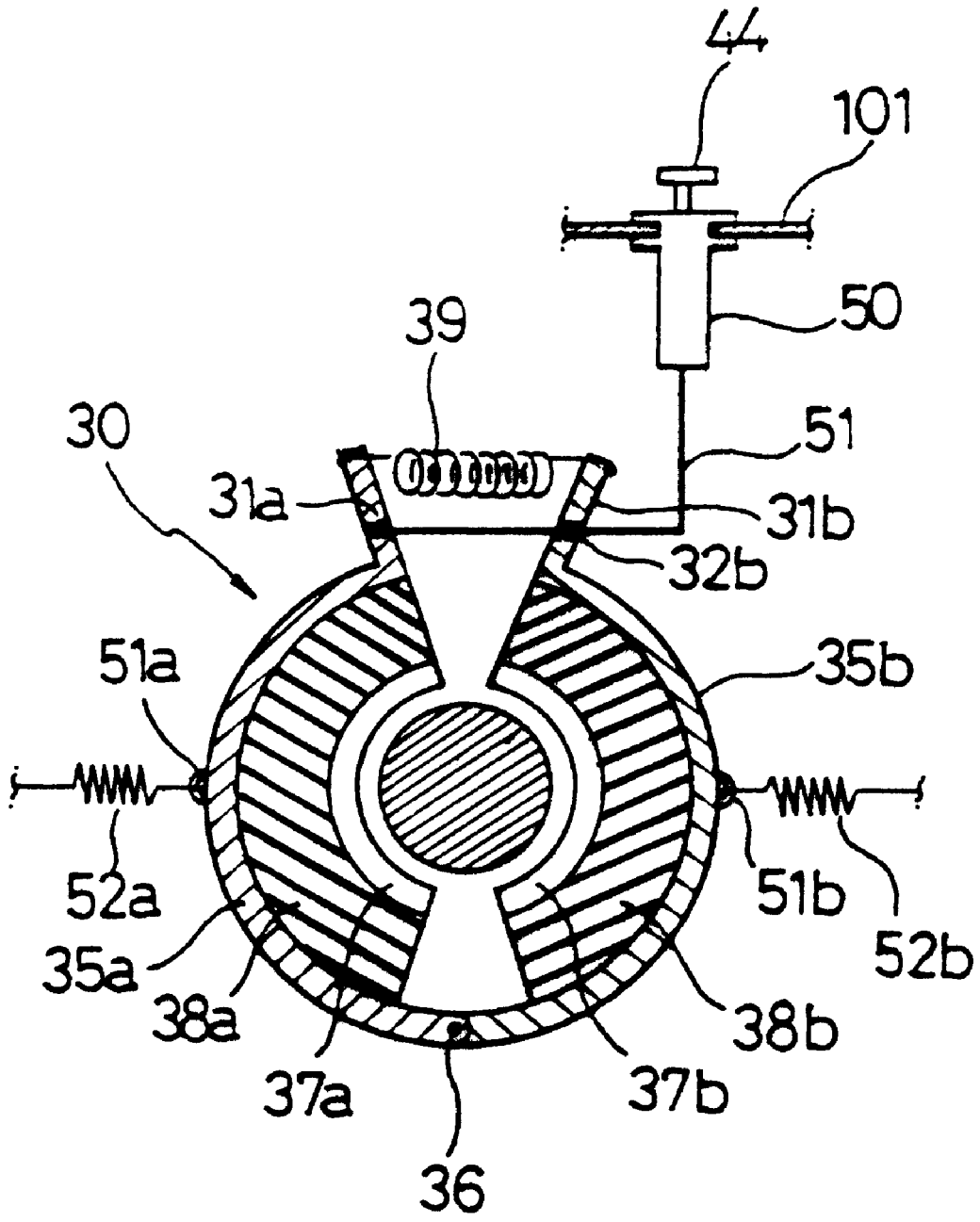
Figure 5B:
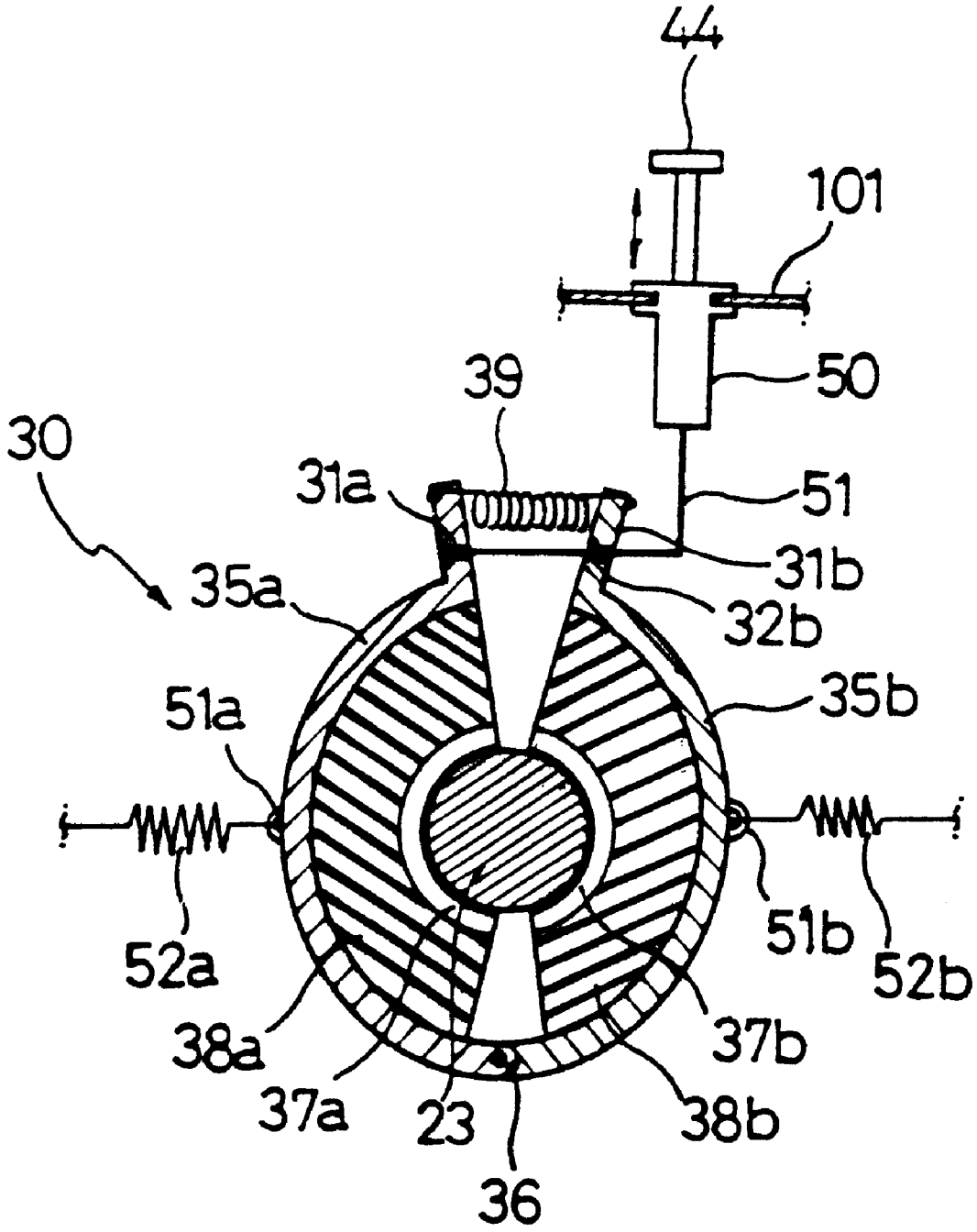
Figure 6:
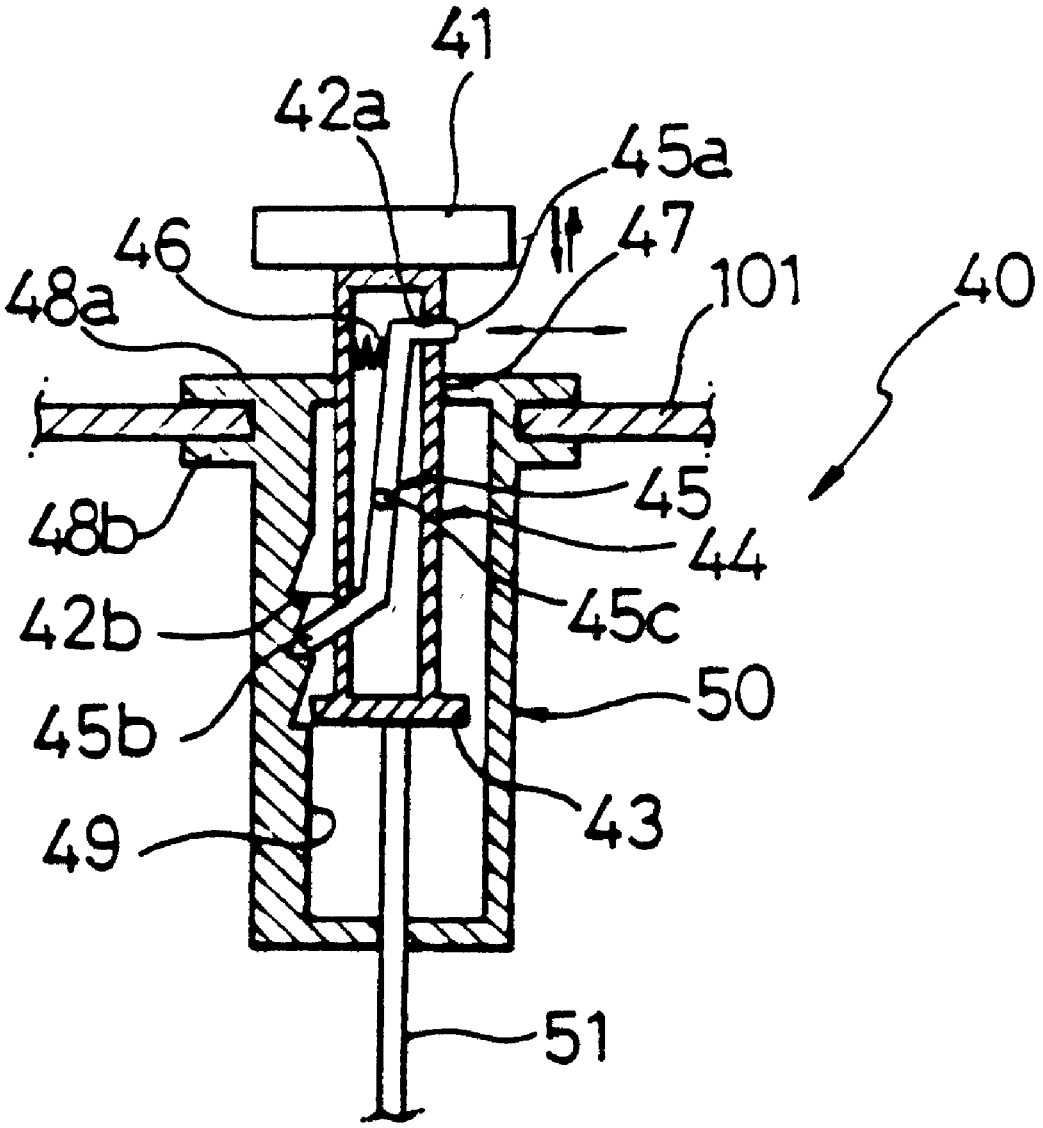
FIG. 6 is a sectional view showing the construction of an actuating unit included in the cable holding device of this invention.

In a detailed description, one end of the cable 20 is connected to the pedal 10, while the other end is connected to the injection pump 21 as best seen in FIG. 2. In such a case, the injection pump connection end of the cable 20 is provided with the rod 23 at which a plurality of projection parts 22 are formed, thus being connected to the pump 21 through the rod 23. FIGS. from 3 to 6 show the construction of the cable holding device of this invention in detail. As shown in the drawings, the cable holding unit 30 consists of a pair of plates 35*a* and 35*b*, which have the same configuration and construction and are coupled to each other into a single body. Each of the two plates 35*a* and 35*b* is cast into a single structure and consists of three parts, that is, a flat panel part 31*a*, 31*b* at the upper portion, a rounded panel part 33*a*, 33*b* at the lower portion and a hinge pin holder part 34*a*, 34*b* at the bottom edge of the rounded panel part 33*a*, 33*b*. The flat panel part 31*a*, 31*b* has one hole 32*a*, 32*b*, while the hinge pin holder part 34*a*, 34*b* is holed so as to receive a hinge pin 36. The plates 35*a* and 35*b* are hinged to each other by the pin 36 at the hinge pin holder parts 34*a* and 34*b*. A rubber pad 38*a*, 38*b* is attached to the arcuate inside surface of each of the rounded panel parts 33*a* and 33*b*, thus having an arcuate holding surface 37*a*, 37*b* suitable for selectively holding the rod 23 of the cable 20. The two flat panel parts 31*a* and 31*b* are connected to each other by a first compression coil spring 39 with both ends of the spring 39 being coupled to the holes 32*a* and 32*b* of the two parts 31*a* and 31*b*. A spring holder 51*a*, 51*b* is formed on the outside surface of each of the rounded panel parts 33*a* and 33*b*. A second tension coil spring 52*a*, 52*b* is coupled to each of the two spring holders 51*a* and 51*b* at one end and is coupled to the chassis 100 at the other end so as to elastically open the plates 35*a* and 35*b*.

The actuating unit 40 comprises a cylindrical housing 50 and an actuator 44. The cylindrical housing 50 is tightly set on a crash pad 101, thus being stably positioned in its place in the chassis 100, while the actuator 44 is axially and movably received into the housing 50. The housing 50 has a hole 47 at the center of a top portion. Two fitting flanges 48*a* and 48*b* are provided at the top end portion of the housing 50, thus forming an annular fitting groove therebetween and allowing the housing 50 to be set on the crash pad 101 at the fitting groove. A linear ratchet 49, having a predetermined width, is formed along the length of the inside wall of the housing 50 from the top to the bottom. Meanwhile, the actuator 44 has a hollow cylindrical body, which is closed at both ends and is integrated with a horizontal handle 41 at the top end. In the actuator 44, two holes or upper and lower holes 42*a* and 42*b* are respectively formed at the upper and lower portions of the cylindrical body's side wall and are opened to opposite directions. The bottom end of the actuator's cylindrical body is flanged, thus forming a stop flange 43. A push lever 45, having an almost S-shaped configuration, is installed in the actuator's cylindrical body, with both ends or push and pawl ends 45*a* and 45*b* of the lever 45 respectively passing through the upper and lower holes 42*a* and 42*b* of the cylindrical body. The lever 45 is hinged to the cylindrical body at the middle portion by a hinge pin 45*c* and is biased by a second compression coil spring 46 at the back surface of the upper portion, thus allowing the push end 45*a* of the lever 45 to be normally biased to the outside of the upper hole 42*a*. The above actuator 44 is movably inserted into the housing 50 in a way such that the pawl end 45*b* of the lever 45 is selectively caught by or released from the ratchet 49 in accordance with an operation of the spring-biased lever 45. That is, when the push end 45*a* of the lever 45 is pushed by a driver while compressing the spring 46, the pawl end 45*b* of the lever 45 is released from the ratchet 49, thus allowing the actuator 44 to be moved downwardly in the housing 50. Meanwhile, when the pushing force is removed from the push end 45*a*, the pawl end 45*b* is caught by the ratchet 49, thus preventing an unexpected downward movement of the actuator 44 in the housing 50. The bottom wall of the actuator's cylindrical body is connected to the spring-biased flat panel parts 31*a* and 31*b* through a connection cable 51, thus selectively closing the two hinged plates 35*a* and 35*b* of the holding unit 30 while compressing the spring 39 and tensioning the two springs 52*a* and 52*b* when the actuator 44 is pulled by a driver.

The operational effect of the cable holding device of this invention will be described hereinbelow.

In order to keep a vehicle steadily running at a constant speed, a driver, putting his foot down on the pedal 10, pulls the actuator 44 while pushing the push end 45*a* of the actuator's lever 45. The actuator 44 thus moves upwardly in the housing 50 while pulling the connection cable 51, thus closing the two hinged plates 35*a* and 35*b* of the holding unit 30 while compressing the spring 39 and tensioning the two springs 52*a* and 52*b*. Therefore, the two rubber pads 38*a* and 38*b* are brought into compression contact with the rod 23 of the accelerator cable 20, thereby tightly holding the rod 23 of the cable 23. When the pushing force of the lever 45 is removed from the push end 45*a* of the lever 45, the pawl end 45*b* of the lever is elastically caught by the ratchet 49 of the housing 50 and prevents the actuator 44 from being unexpectedly moved downwardly in the housing 50 due to the pulled connection cable 51. Therefore, the holding unit 30 is kept tightly holding the cable 20, thus allowing the driver to drive the vehicle at a constant speed without continuously putting his foot down on the pedal 10. In order to release the rod 23 from the holding unit 30 prior to increasing or reducing the running speed of the vehicle, the push end 45*a* of the lever 45 is pushed, thus releasing the pawl end 45*b* from the ratchet 49 of the housing 50 and releasing the pulled connection cable 51. The two plates 35*a* and 35*b* in the above state are elastically opened due to the restoring force of the springs 39, 52*a* and 52*b*, thus releasing the rod 23 of the cable 20 and allowing the driver to operate the pedal 10 so as to control the running speed of the vehicle.

As described above, the present invention provides a cable holding device for accelerator pedals. The device keeps an accelerator cable connected to an engine's injection pump without allowing the cable to be returned from the pump when a driver removes a pressure force from the pedal after the driver puts his foot down on the pedal, thus keeping a previously depressed state of the pedal and allowing the driver to easily and conveniently drive the vehicle at a constant speed without continuously putting his foot down on the pedal.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A cable holding device in a vehicle with an accelerator connected with an infection pump of an engine, comprising:

an accelerator cable connecting an accelerator pedal to an injection pump of an engine;

a rod provided adjacent an end of said cable for connecting said injection pump, said rod having an outer surface and a plurality of projection parts on said outer surface;

a cable holding unit selectively holding said rod so as to hold the cable at a previous state, thus allowing a vehicle to run at a constant speed when a pressure force is removed from said pedal, said cable holding unit comprising:

a pair of plates hinged to each other at their bottom edges, each of said two plates consisting of a holed flat panel part at the upper portion, a rounded panel part at the lower portion and a hinge pin holder part at the bottom edge of the rounded panel part;

a rubber pad attached to an inside surface of each of said rounded panel parts, thus selectively holding said rod of the cable;

a first spring coupled to the flat panel parts of the two plates at both ends, thus normally biasing the two plates so as to elastically open the plates around the hinged bottom edges; and two second springs coupled to each of the two spring holder at one end and coupled to the chassis at other end so as to elastically open the plates; and an actuating unit selectively actuating said cable holding unit so as to hold the cable by the cable holding unit.

2. A cable holding device in a vehicle with an accelerator connected with an injection pump of an engine, comprising:

an accelerator cable connecting an accelerator pedal to an injection pump of an engine;

a rod provided adjacent an end of said cable for connecting said injection pump, said rod having an outer surface and a plurality of projection parts on said outer surface;

a cable holding unit selectively holding said rod so as to hold the cable at a previous state, thus allowing a vehicle to run at a constant speed when a pressure force is removed from said pedal; and an actuating unit selectively actuating said cable holding unit so as to hold the cable by the cable holding unit, said actuating unit comprising:

a cylindrical housing tightly set on a crash pad, said housing having:

a center hole formed at the center of a top portion;

two fitting flanges provided at the end of the top portion, thus forming an annular fitting groove for setting the housing on the crash pad; and a linear ratchet formed along the length of the inside wall of the housing; and an actuator axially and movably received into said housing through the center hole, said actuator having:

a hollow cylindrical body, with upper and lower holes being respectively formed at the upper and lower portions of a cylindrical body's side wall and being opened to opposite directions, said cylindrical body also having a stop flange at its bottom wall;

a horizontal handle integrated with the top end of said cylindrical body; and a push lever installed in the cylindrical body, with both ends or push and pawl ends of the lever respectively passing through the upper and lower holes of the cylindrical body, said lever being hinged to the cylindrical body at the middle portion and being biased by a spring so as to allow the push end to be normally biased to the outside of the upper hole, said pawl end being selectively caught by or released from said ratchet of the housing in accordance with an operation of the push lever; and a connection cable connecting said actuator to the cable holding unit, thus allowing the cable holding unit to be selectively closed so as to hold said rod when the actuator is pulled.

* * * * *